United States Patent [19]

Avedesian et al.

[11] 4,212,722

[45] Jul. 15, 1980

[54] APPARATUS FOR ELECTROWINNING METAL FROM METAL BEARING SOLUTIONS

[75] Inventors: Michael M. Avedesian, Beaconsfield; Anthony P. Holko, Mount Royal, both of Canada

[73] Assignee: Noranda Mines Limited, Toronto, Canada

[21] Appl. No.: 960,632

[22] Filed: Nov. 14, 1978

Related U.S. Application Data

[62] Division of Ser. No. 793,776, May 4, 1977, Pat. No. 4,141,804.

[30] Foreign Application Priority Data

May 11, 1976 [CA] Canada ..... 252269

[51] Int. Cl.[2] ..... C25D 21/18; C25B 15/08; C25C 5/02; C25C 7/00

[52] U.S. Cl. ..... 204/222; 204/237; 204/258; 204/265; 204/266; 204/283

[58] Field of Search ..... 204/234, 237, 222, 263, 204/265, 266, , 118, 260, 283, 258

[56] References Cited

U.S. PATENT DOCUMENTS

| | | | |
|---|---|---|---|
| 3,703,446 | 11/1972 | Haycock et al. | 204/222 X |
| 3,787,293 | 1/1974 | Kametani | 204/118 X |
| 3,941,669 | 3/1976 | Bharucha et al. | 204/222 X |
| 4,032,425 | 6/1977 | Kametani | 204/222 X |
| 4,096,053 | 6/1978 | Emmett et al. | 204/222 X |

*Primary Examiner*—John H. Mack
*Assistant Examiner*—D. R. Valentine
*Attorney, Agent, or Firm*—Fleit & Jacobson

[57] ABSTRACT

A process and an apparatus for electrowinning metal from metal bearing solutions is disclosed. A support solution containing a predetermined metal concentration is continuously recirculated through a cell having a porous grid supporting a bed of particulate conducting particles at a sufficiently high flow rate so as to fluidize and expand the bed by 5 to 25%. A gas is continuously fed through the bed of conducting particles so as to strongly agitate the particles at low bed expansion to maintain good mixing and uniform fluidization of the bed of particles. The cell includes an electrode arrangement suspended from the top of the cell and immersed into the bed of fluidized conducting particles. Such electrode arrangement consists of at least one cathode feeder electrode in physical contact with the fluidized particles to make the particles cathodic and so cause the metal ions to deposit on the particles, and at least one anode electrode separated from the cathodic particles by a membrane which allows the free passage of ions while preventing physical contact with the particles. To make the process continuous or semi-continuous, the cell has an inlet for adding small seed particles and an outlet adjacent to the bottom for withdrawing large product particles.

9 Claims, 19 Drawing Figures

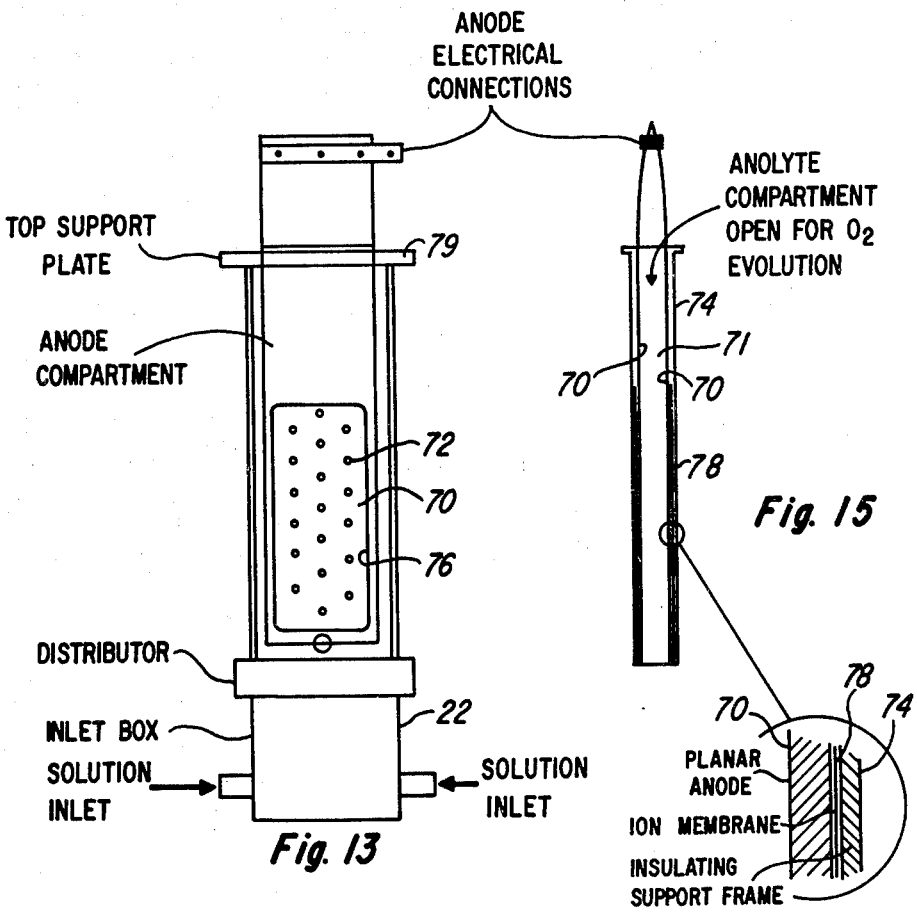
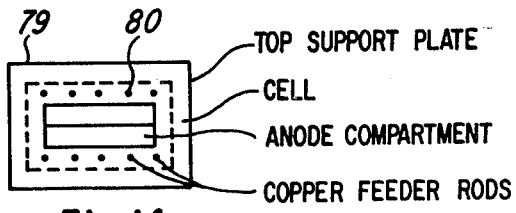
Fig. 14

APPARATUS FOR ELECTROWINNING METAL FROM METAL BEARING SOLUTIONS

This is a divisional of application Ser. No. 793,776, filed May 4, 1977, now U.S. Pat. No. 4,141,804.

This invention relates to a process for electrowinning metal from metal bearing solutions and to a fluidized-bed electrochemical cell for carrying out such process.

The electrowinning of metal such as copper from leach solutions using conventional "fixed area" electrode sheets are limited because such arrangements exhibit concentration polarisation at high current intensities and low metal concentrations, and this leads to a high specific power consumption. In addition, a major cost item in conventional electrowinning is the periodic removal and insertion of the electrode sheets during which time the electrochemical reaction is stopped.

Recently, fluidized-bed electrodes have been proposed for electrowinning metal from metal bearing solutions. Such fluidized-bed electrodes generally consist of fine particles of metal or metal coated glass or plastic beads contained in a suitably designed cell and fluidized by the passage of an electrolyte solution containing the metal to be electrodeposited on the bed of particles. Electrical feeders in contact with the particulate bed and auxiliary electrodes complete the electrochemical circuit. The fluidized-bed electrodes have a great advantage over the "fixed area" electrodes because the cathodic current density is greatly reduced due to the large specific surface area of the fluidized bed of conducting particles as compared with the fixed area electrodes. Consequently, the current intensity (amperes/cubic meter of bed volume) is increased and the cell size is much smaller than with the conventional electrowinning processes. A fluidized-bed electrode system may also be operated continuously or semi-continuously by adding small seed particles to the bed and removing large product particles. The cost of periodically removing the cathode sheets and inserting new ones in the conventional processes is thereby eliminated.

In order to obtain an optimum performance from a fluidized-bed electrode system, it has been found that the bed expansion should be kept below 25% because, for bed expansions greater than 25%, the electrolyte conductivity is the controlling cell resistance and the electrochemical cell tends to function like a conventional electrowinning cell. The bed particles are not active for electrodeposition because the contact frequency of the particles with the feeders is low at high bed voidages. Consequently, electrodeposition occurs mainly at or near the cathode feeders as in conventional electrowinning. High rates of deposition at the feeder surfaces increase the probability that the particles of the bed will weld upon contact with the feeders. However, at low bed expansions, fluidization is not intense and the kinetic energy of the particles is low leading to channelling of electrolyte through the bed, and localized defluidization.

It is therefore one object of the present invention to provide a means of maintaining an intense state of agitation in fluidized-bed electrode systems operating at low bed expansions. This has been achieved by feeding gas through the bed of conducting particles so as to maintain good mixing and uniform fluidization of the bed at low bed expansions.

The process for electrowinning metal from metal bearing solutions, in accordance with the invention, thus comprises the steps of continuously recirculating a support solution of a predetermined metal concentration through a bed of particulate conducting particles at a sufficiently high flow rate so as to fluidize and expand the bed by 5 to 25%, continuously feeding gas through the bed of conducting particles so as to strongly agitate such particles at low bed expansion to maintain good mixing and uniform fluidization of the bed of particles, passing electricity through the bed by immersing into the bed at least one cathode feeder electrode in physical contact with the fluidized particles to make such particles cathodic and so cause the metal ions to deposit on the particles, and anode electrodes separated from the cathodic particles by a membrane which allows the free passage of ions but prevents physical contact with the particles, and adding small seed particles to the bed and withdrawing large product particles from the bed to make the process continuous or semi-continuous.

It is also an object of the present invention to operate the fluidized-bed electrochemical cell at optimum conditions independent of the metal concentration in the metal bearing solution.

For that purpose, a solution with a high metal concentration, the so-called "pregnant" solution, is fed into the high flow rate support solution at a lower flow rate which depends on the ratio of the desired metal concentration in the support solution to the metal concentration in the pregnant solution. A solution with a low metal concentration, the so-called "spent" solution, is continuously bled from the support solution at a flow rate about equal to the flow rate of the pregnant solution. The spent solution may be recycled and mixed with the pregnant solution.

The apparatus for electrowinning metal from metal bearing solutions comprises at least one cell having a porous grid supporting a bed of particulate conducting particles, means for continuously recirculating the support solution of predetermined metal concentration through the bed of conducting particles at a sufficiently high flow rate to fluidize and expand the bed by 5 to 25%, means for continuously feeding gas through the bed of conducting particles so as to strongly agitate the particles to maintain good mixing and uniform fluidization of the bed of particles at low bed expansion, an electrode arrangement suspended from the top of the cell and immersed into the bed of fluidized particles and comprising at least one cathode feeder electrode in physical contact with the fluidized particles to make the particles cathodic and so cause metal ions to deposit on the particles, and at least one anode electrode separated from the cathodic particles by a membrane which allows the free passage of ions while preventing physical contact with the particles, and an inlet port at the top of the cell for adding small seed particles as well as an outlet port at the bottom of the cell so as to allow for continuous or semi-continuous withdrawal of the product particles.

The cells are preferably of rectangular cross-section in which the thickness is about one half the width although cylindrical cells may also be used. Plural cells are generally used and the support solution cascaded from one cell to the other or fed to all cells from a center manifold so as to obtain optimum working conditions.

The electrode arrangement in the cell may be in the form of a checkerboard arrangement wherein each anode electrode is surrounded by four cathode feeders and vice-versa. A porous membrane is snuggly fit over the anode electrodes so as to prevent contact of the particles with the anode electrodes but allow passage of ions therethrough. One such membrane is a polyethylene screen cloth. In such a cell the catholyte and anolyte are not separated.

The electrode arrangement in the cell may also be such as to separate the catholyte from the anolyte. In one embodiment of such an electrode, each anode compartment consists of two opposing antimonial lead sheets set at a predetermined distance inside an insulating support frame to form an anolyte compartment. Each anode has holes at a 45° angle to allow the free evolution of oxygen through the inner anolyte compartment. The outside face of each anode sheet, which is totaly immersed in the fluidized-bed of copper particles, is covered with an insulating material except for a window comprising an ion exchange membrane sheet which prevents physical contact between the cathodic copper particles and the anodic antimonial lead sheets. In another embodiment of the invention, the anode may be in the form of an antimonial lead tube covered by an ion exchange membrane which is slipped over the anode. The anode is perforated to allow the free evolution of oxygen inside the hollow tubular antimonial lead anode. A suitable ion exchange membrane would be a perfluorosulphonic acid membrane. Although antimonial lead is one proven alloy material for the anode, any suitable anode material could be used in the present invention.

The porous grid may be a distributor plate provided with a plurality of orifices through which the support solution and the gas are uniformly distributed across the cell. The gas is preferably introduced through a series of bores in the side of the distributor plate and provided with a series of orifices communicating with such bores. The support solution is preferably introduced into the bed through orifices passing through the complete thickness of the distributor plate.

The invention will now be disclosed with reference to a preferred embodiment illustrated in the accompanying drawings in which.

Figure 1:
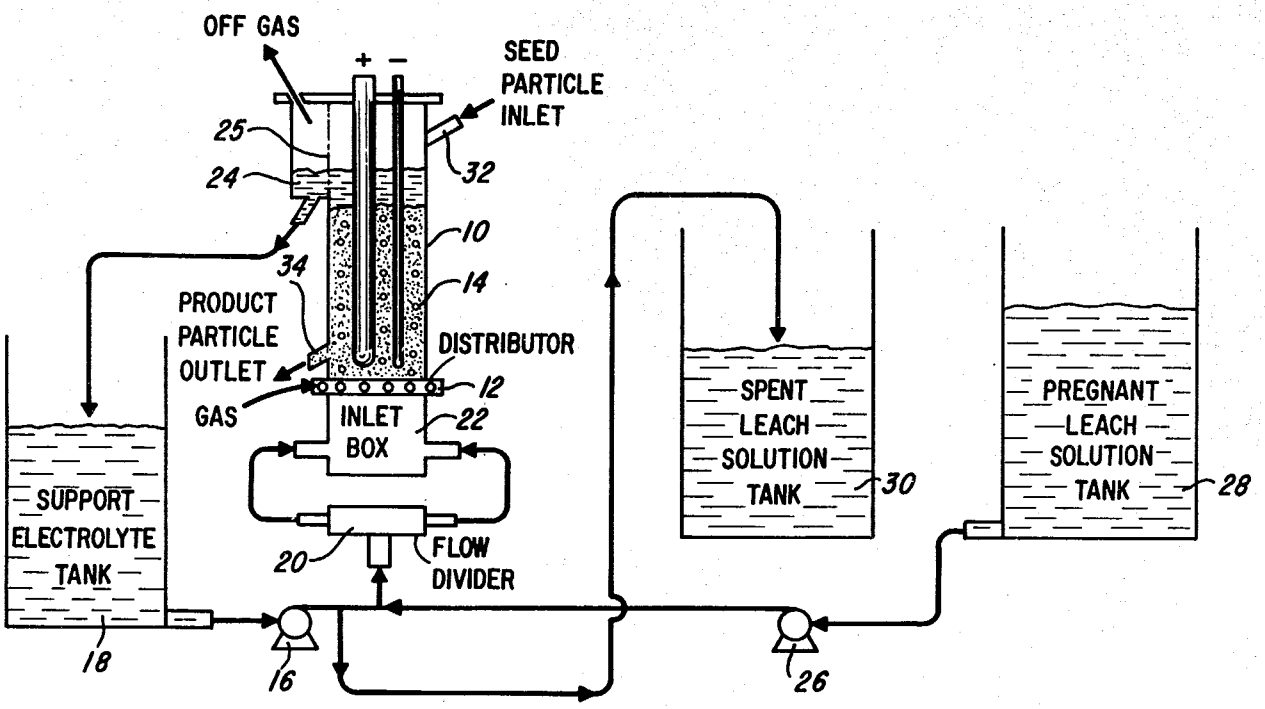
FIG. 1 illustrates a process flow sheet for the continuous operation of a fluidized-bed electrochemical cell in accordance with the invention.
Figure 4A:
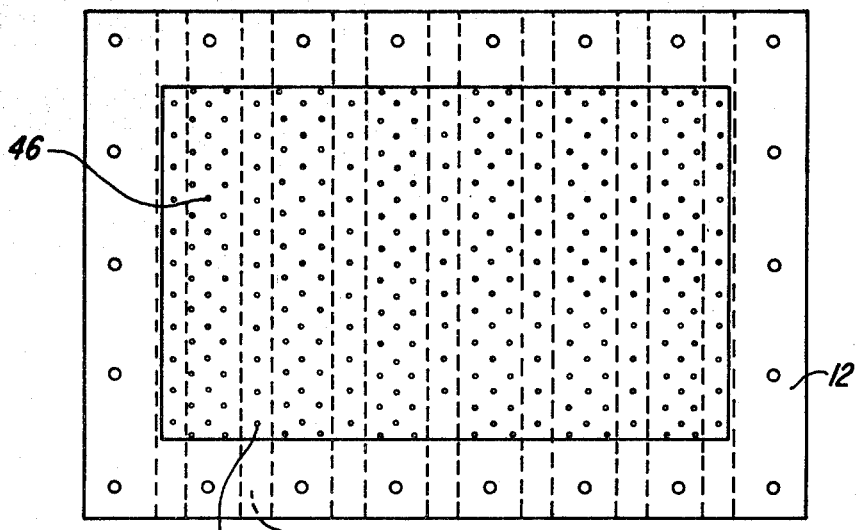
Figure 4B:
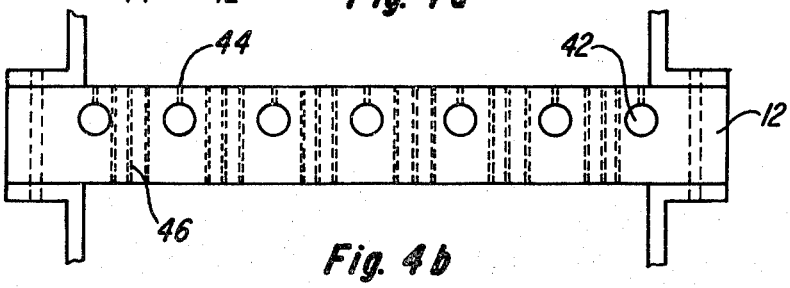
Figure 5:
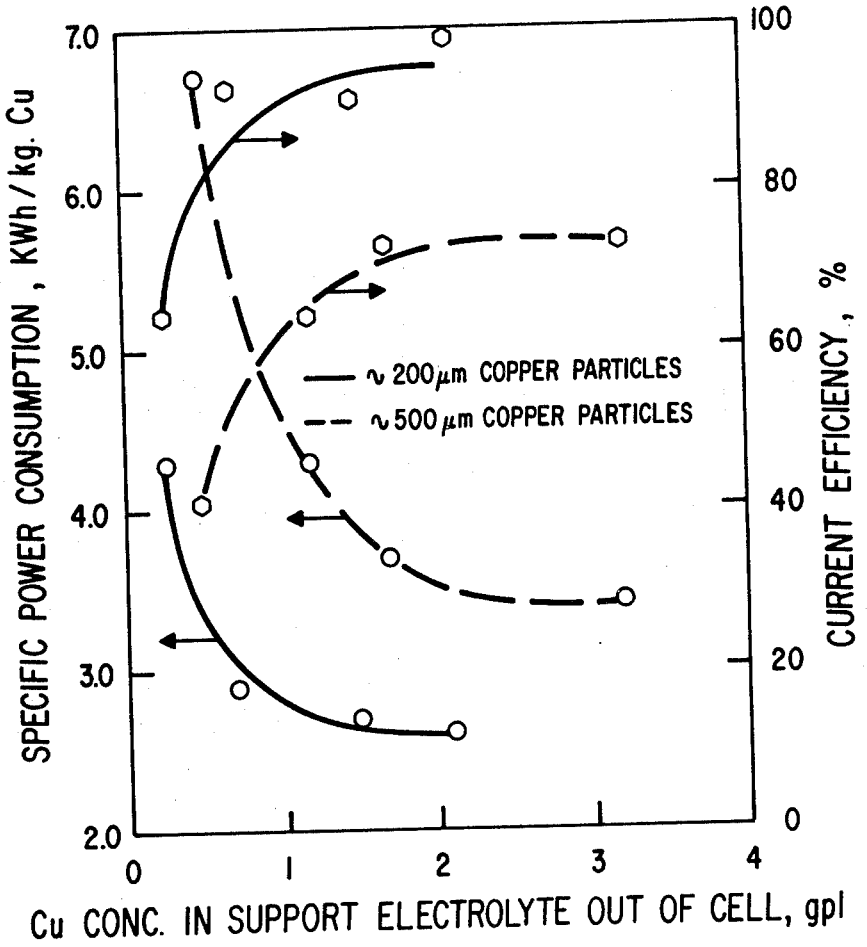
Figure 6:
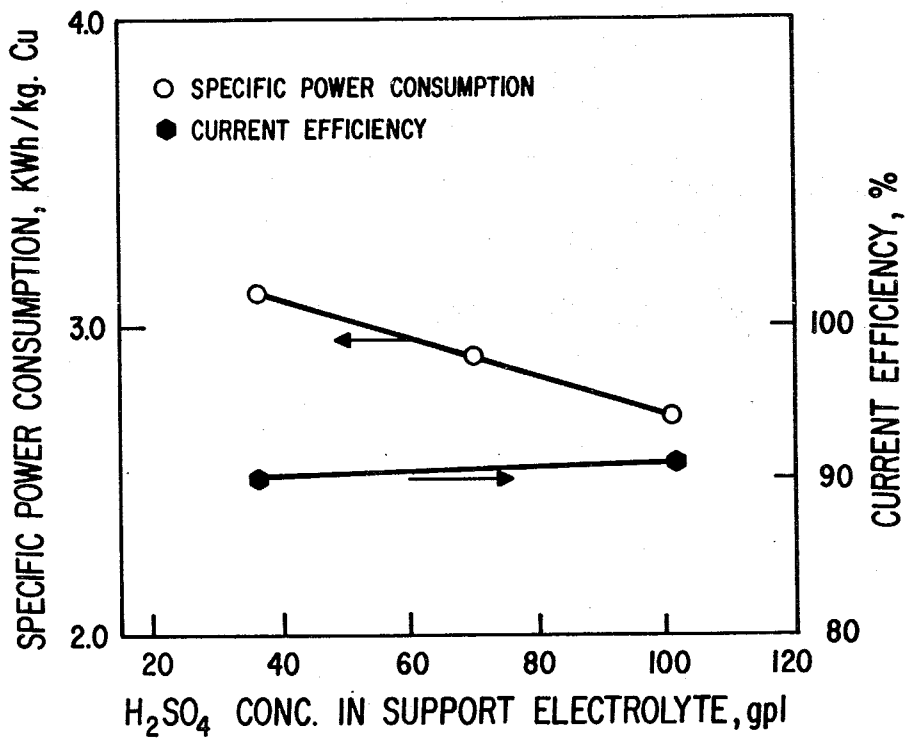
Figure 7:
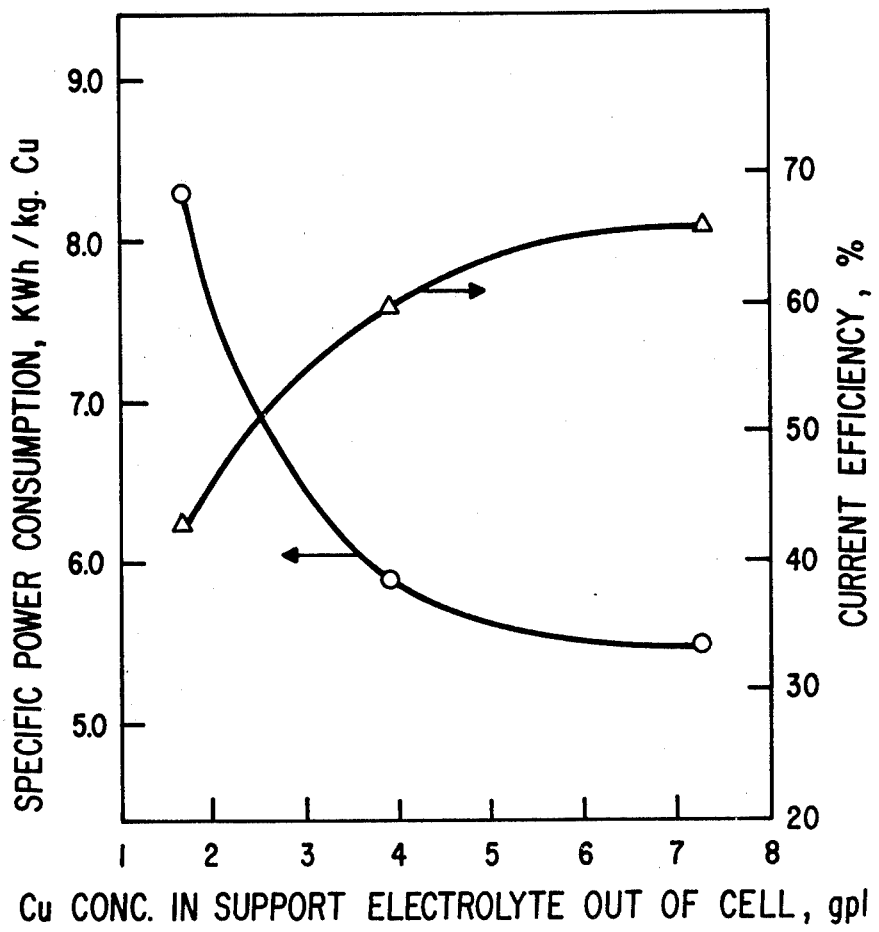
Figure 8:
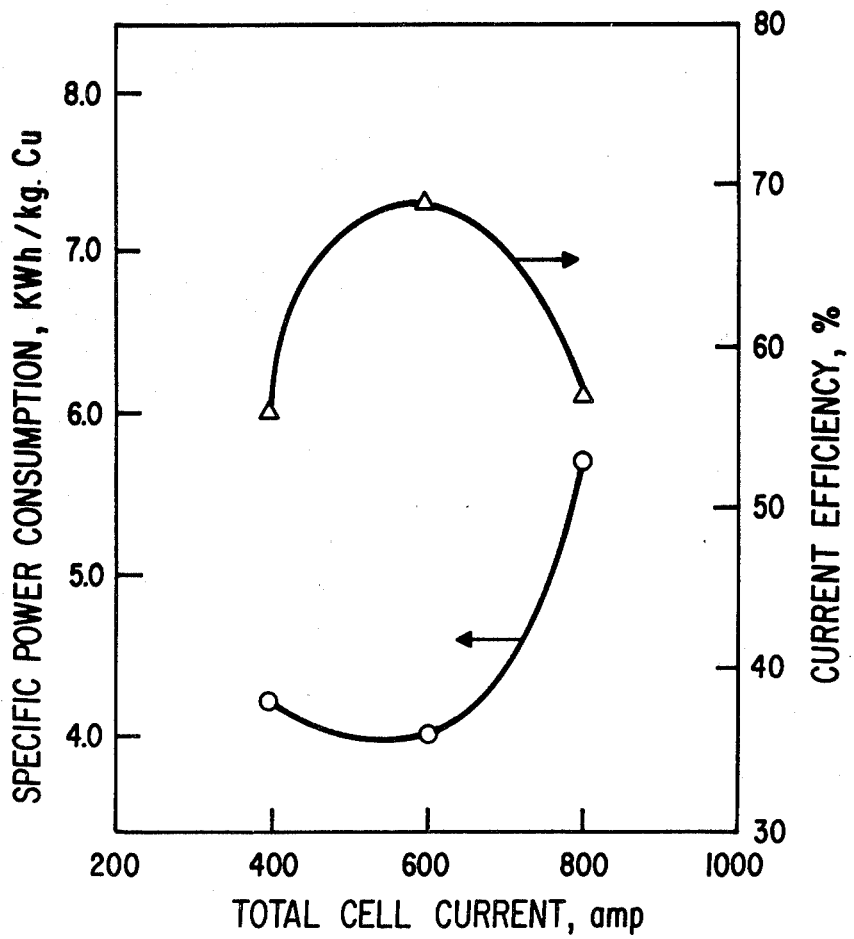
Figure 9:
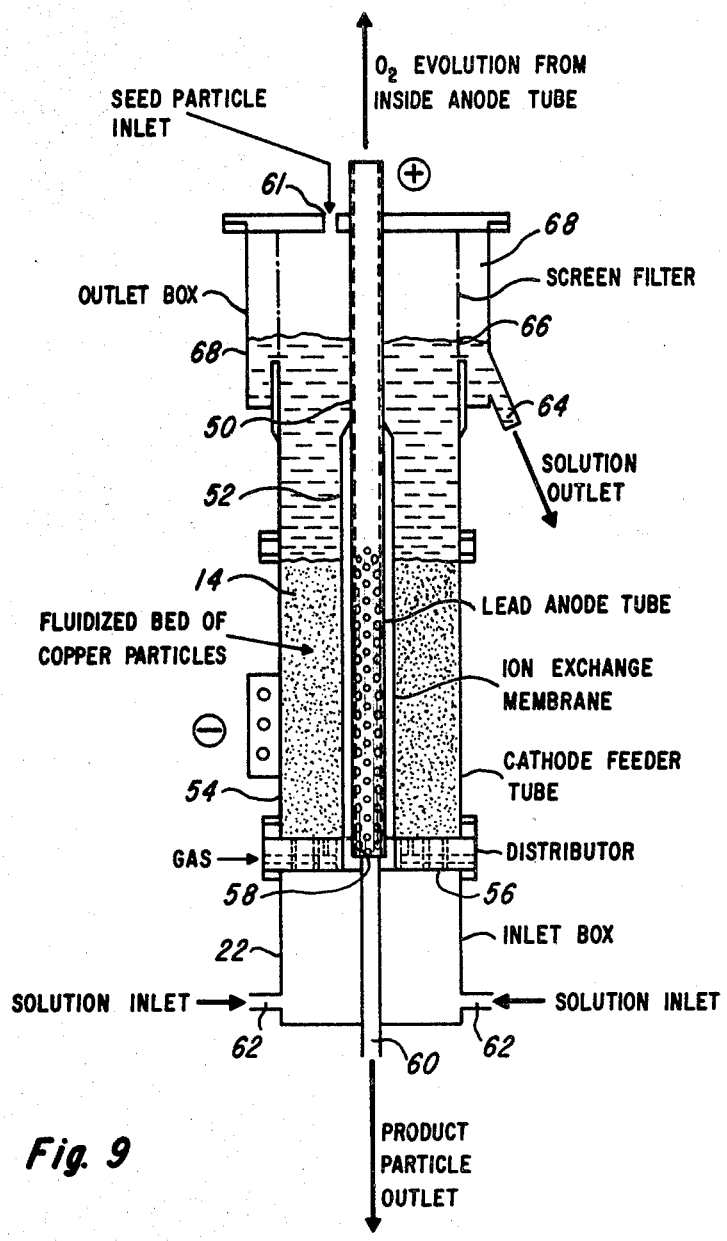
Figure 10:
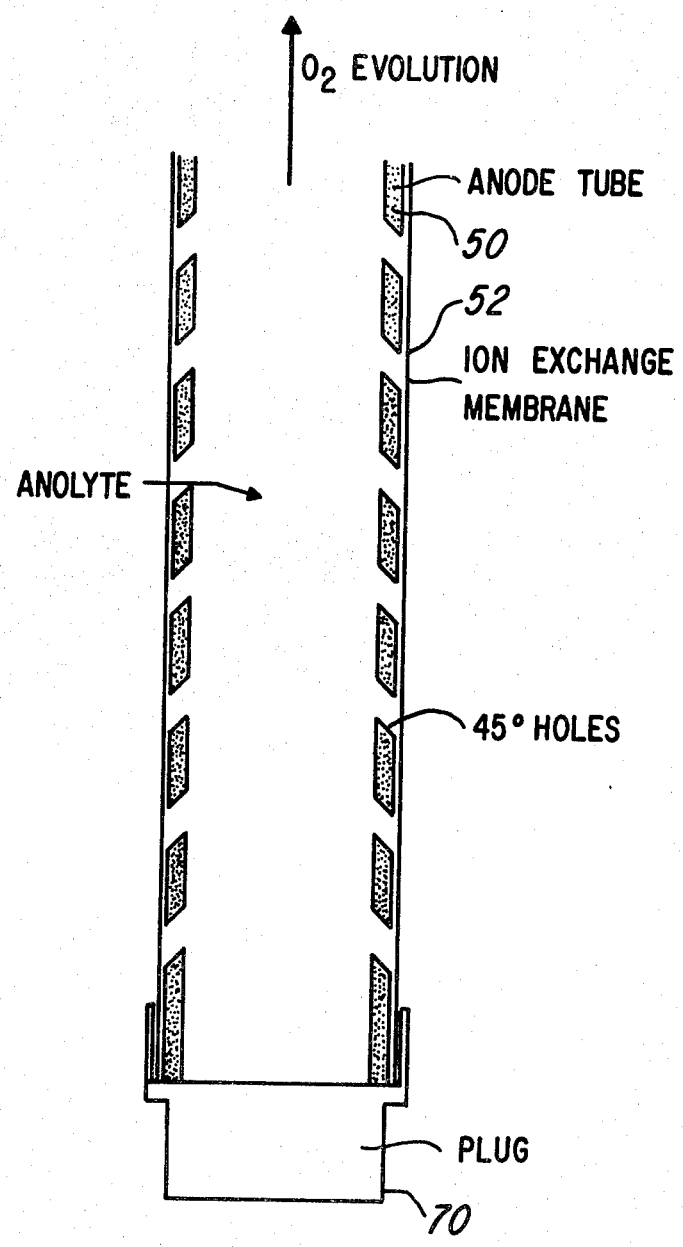
Figure 11:
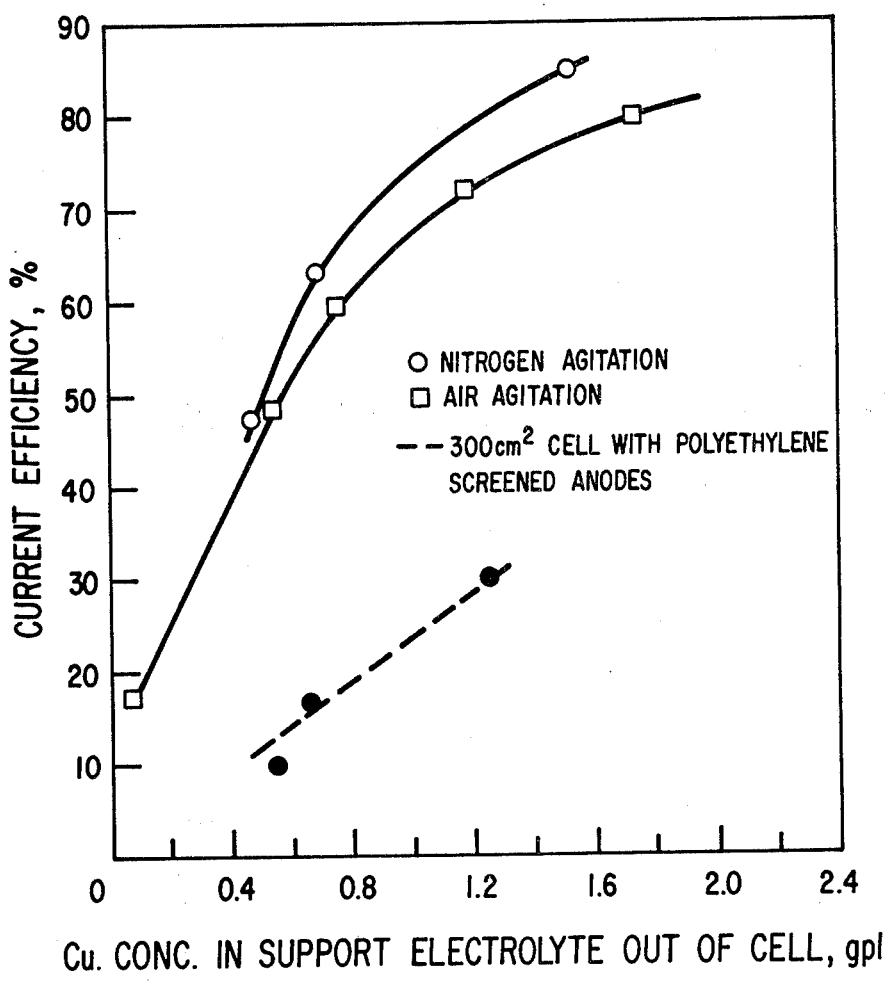
Figure 12:
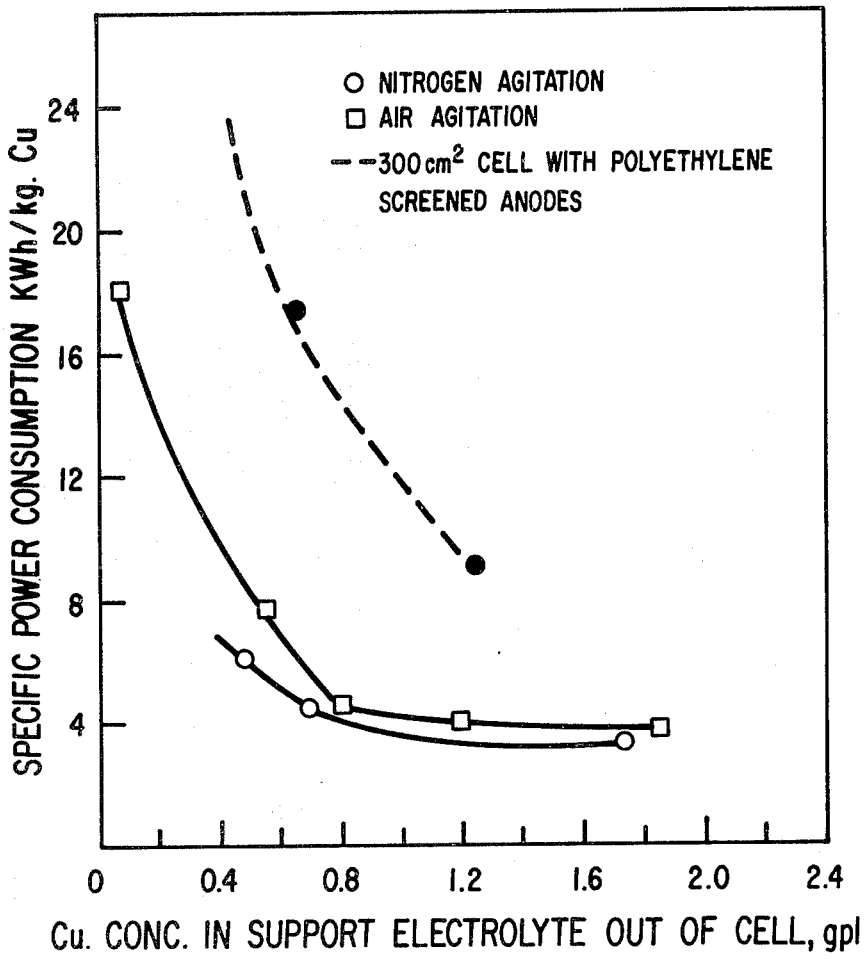
Figure 16:
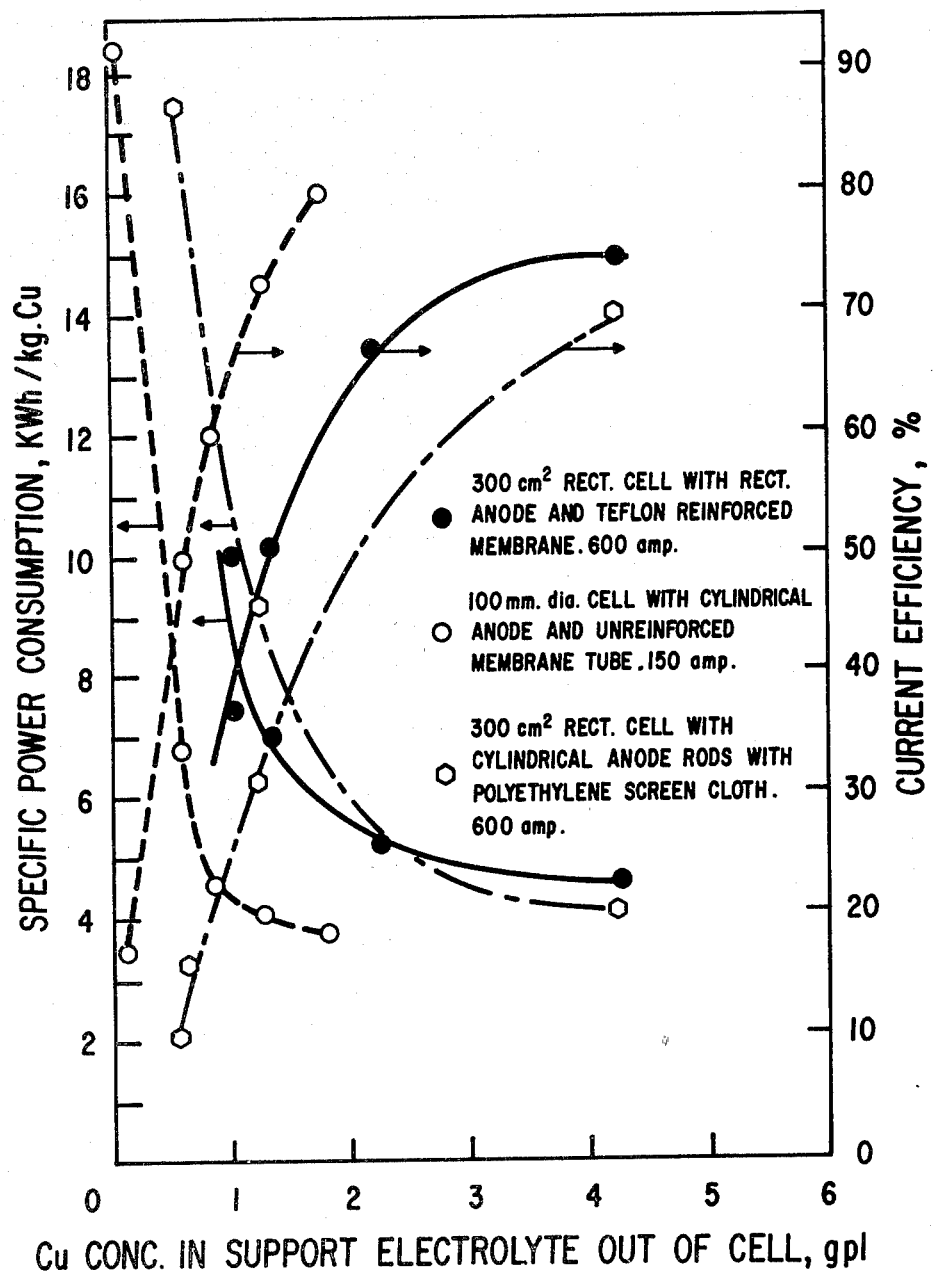
Figure 17:
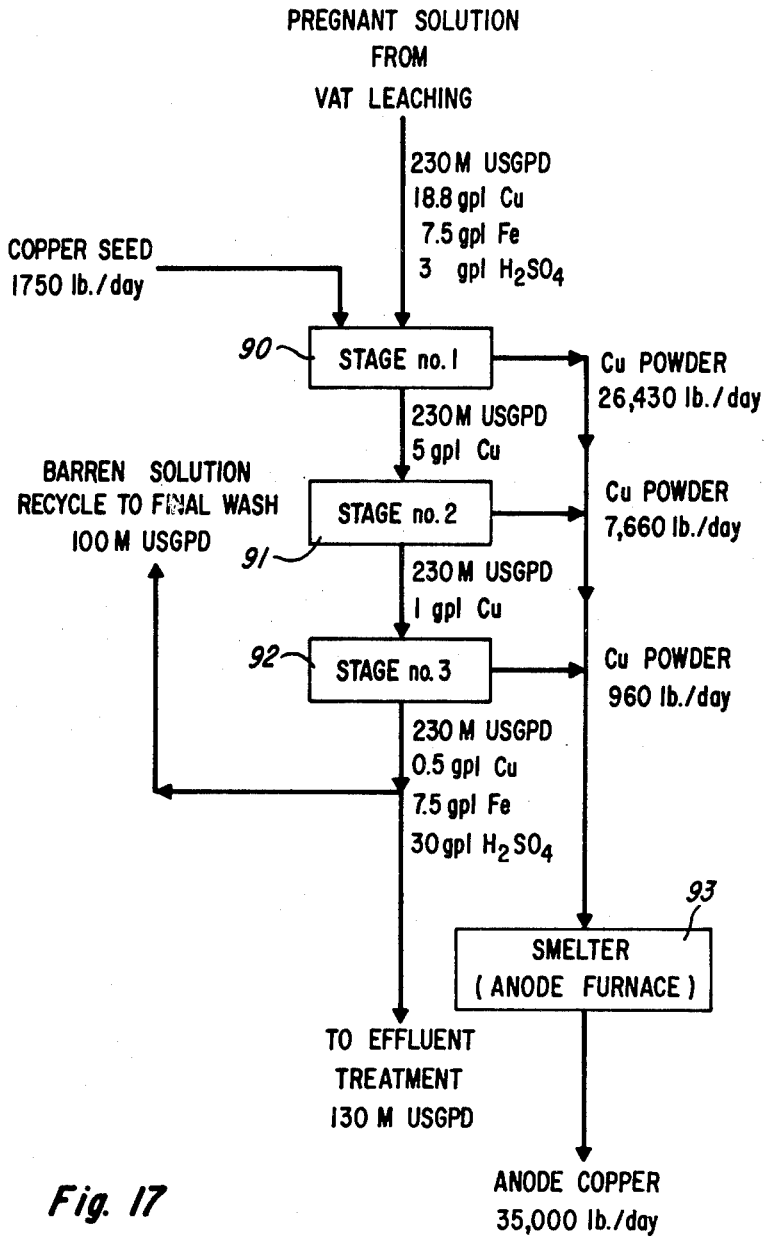
Figure 18:
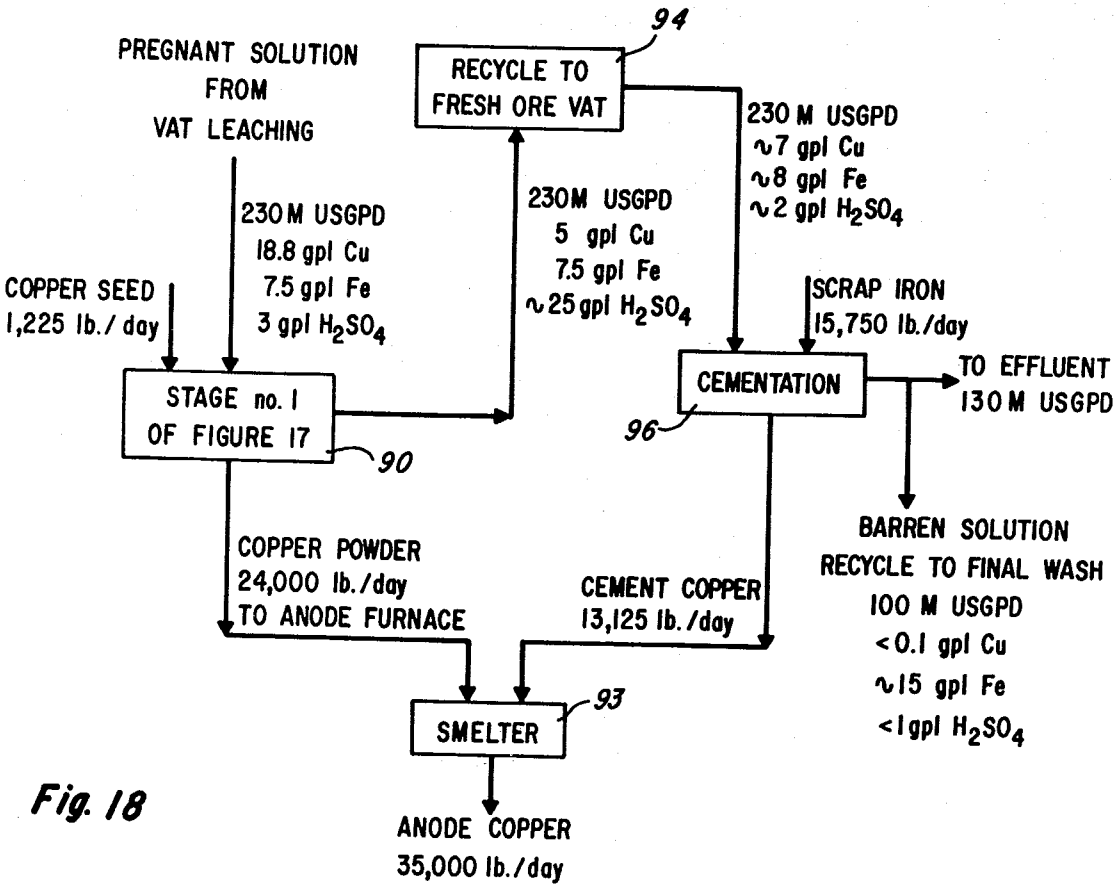

FIGS. 4*a* and 4*b* illustrate plan and side views respectively of the distributor plate for the cell;

FIGS. 5 and 7 illustrate the effect of copper concentration in the support electrolyte on the specific power consumption and current efficiency in a cell with iron-free and iron-bearing solutions respectively;

FIG. 6 illustrates the effect of acid concentration on the specific power consumption and current efficiency in the cell with iron-free solutions;

FIG. 8 illustrates the effect of cell current on the specific power consumption and current efficiency in the cell with iron-bearing solutions;

FIGS. 9 and 10 illustrate another embodiment of a suitable electrochemical cell using an ion exchange membrane;

FIGS. 11 and 12 illustrate respectively the effect of the copper concentration in the support electrolyte on the current efficiency and specific power consumption with an iron-bearing solution and using the cell of FIGS. 9 and 10;

FIGS. 13 to 15 illustrate another embodiment of a suitable electrochemical cell using an ion exchange membrane;

FIG. 16 illustrates the effect of copper concentration in the support electrolyte on the specific power consumption and current efficiency in a cell with iron-bearing solutions and using the cell of FIGS. 13 to 15; and FIGS. 17 and 18 illustrate possible applications of the process of FIG. 1 for the direct electrowinning of leach solutions.

Referring to FIG. 1, there is shown the process flowsheet for the continuous operation of a fluidized-bed electrochemical cell 10 for electrowinning copper bearing leach solutions. It is to be understood that other metal bearing solutions could be electrowon with the process and apparatus disclosed below. The fluidized-bed electrochemical cell 10 includes a distributor plate 12 supporting a bed of conducting particles 14 which are fluidized by a support solution of predetermined copper concentration which is continuously recirculated through the bed of particles by a pump 16 drawing the solution from a recycle tank 18. The support solution is fed through a flow divider 20 into the inlet box 22 of the fluidized-bed electrochemical cell and through orifices in the distributor plate 12. The support solution is returned to the tank 18 from the outlet box 24 of the electrochemical cell 10. A screen filter 25 is provided in the outlet box 24 for preventing copper particles from being entrained with the solution and carried into tank 18. The support electrolyte is circulated at a flow rate sufficient to expand the bed of particles by an amount varying from 5 to 25%. Such flow rate is dependent on the specific gravity of the electrolyte and the particles to be fluidized, and on the dimensions of the particles. Typically, such flow rate may be about 10 l/min. for a support solution containing 2–3 gpl Cu, 20–30 gpl $H_2SO_4$, 2 gpl Al and 7 gpl total Fe through a cell of 300-$cm^2$ cross-sectional area.

It has been found that at bed expansions greater than 25%, the electrolyte conductivity is the controlling cell resistance and the cell functions as a conventional electrowinning cell. The copper particles are not active for electrodeposition because the contact frequency of the particles with the feeders is low at high voidages, giving rise to a steep electron concentration gradient in the particulate phase. Metal deposition occurs mainly on the feeders as in conventional electrowinning. This enhances particulate welding on the feeders in spite of the relatively high kinetic energy of the particles at the high voidages. The drag force between the particles and the feeders reduce their velocity, and some particles may stagnate at the surface for a sufficient time to weld. Experiments confirmed that welding was enhanced at high bed expansions. For bed expansions less than 25%, the current increases which implies that the particulate copper phase is the controlling cell resistance. Metal deposition occurs mainly on the bed particles, which is desirable. However, at low voidages, the kinetic energy of the particles is low. This enhances channelling, localized defluidization and stagnation at the internal surfaces. Eventually some particles will weld on the surface although the rate will not be as great as for high expansions, because there is very little reaction at the feeders.

In order to overcome the above problems, applicant has surprisingly found that if air or inert gas such as nitrogen is fed through the bed of fluidized particles so as to create intense particle agitation, good mixing and uniform fluidization in the bed is obtained. Injecting gas bubbles into the bed offers a means of operating the bed at low expansions while maintaining an intense state of agitation. Gas bubbles rising through the bed carry electrolyte, void of particles, in their wake at a higher velocity than the mean superficial velocity of the electrolyte. The interstitial velocity of the electrolyte in the particulate phase must therefore decrease to maintain the material balance over any cross-section, which leads to a further reduction in expansion, a lower voidage in the particulate phase and the bed contracts. In addition, the gas bubbles supply an independent source of agitation to the bed. Initial experiments without gas injection proved unsuccessful as there was severe welding of copper particles onto the feeders. Subsequent experiments with gas injection proved that welding could be eliminated at low bed expansion whilst maintaining an intense state of agitation. In addition, the current efficiency with gas injection increased and the cell voltage decreased.

A pregnant leach solution is fed into the high flow rate support solution stream at its point of entry into the flow divider 20 by a pump 26 drawing the solution from a tank 28. The flow rate of the pregnant leach solution depends on the copper concentration of the pregnant leach solution. The system provides flexibility in that it allows the fluidized-bed electrochemical cell to be operated at optimum conditions independent of the pregnant leach solution copper concentration. Typically, a pregnant leach solution containing 18 gpl Cu, 3 gpl $H_2SO_4$, 2 gpl Al and 7 gpl total Fe may be mixed with the support solution at a rate of 1 l/min when the support solution containing 2–3 gpl Cu, 20–30 gpl $H_2SO_4$, 2 gpl Al and 7 gpl total Fe is circulated through the bed at a flow rate of 10 l/min. The acid concentration in the support solution reaches a steady state stoichiometric value which depends only on the difference in copper concentration between the pregnant leach solution and the spent solution, as well as the acid concentration in the pregnant leach solution. The advantage of the above scheme is that pregnant leach solutions containing high copper and low acid can be continuously electrowon to low copper with very little or no acid make-up. A spent solution, which at a steady state is identical to the support solution, is bled from the high flow rate support solution stream (at about the same rate as the pregnant leach solution) and stored into tank 30 by pump 16.

Small seed particles are added to the bed through an inlet 32 in the upper portion of the cell while large product particles are withdrawn from an outlet 34 to make the overall process continuous or semi-continuous.

Figure 2:
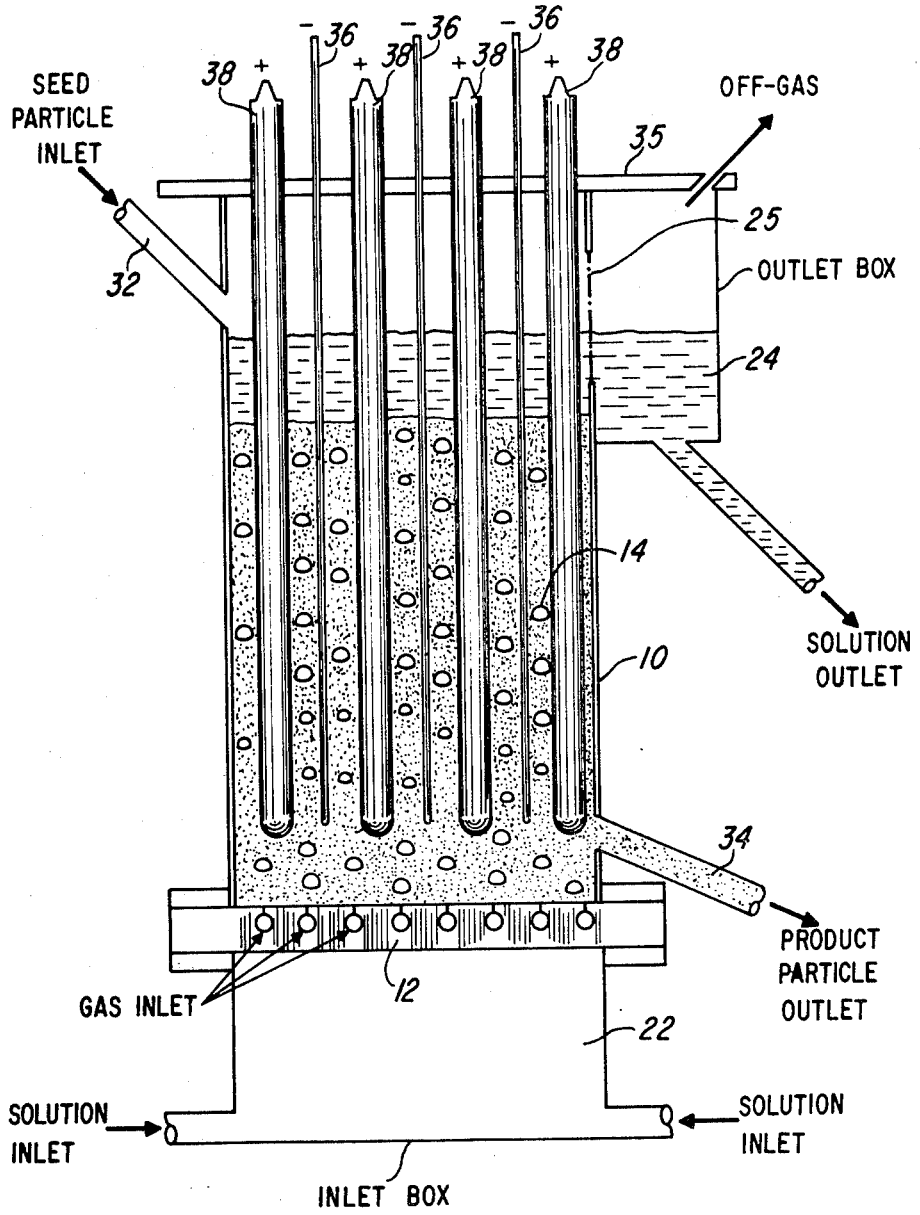
FIG. 2 illustrates a more detailed view of a suitable electrochemical cell.
Figure 3:
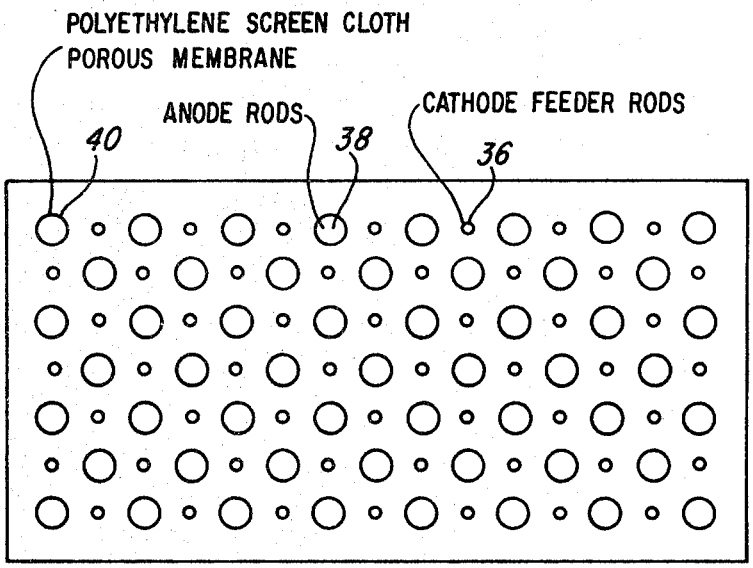
FIG. 3 illustrates a plan view cross-section through the cell to show the electrode arrangement.

Returning now to the description of the fluidized-bed electrochemical cell, FIGS. 2, 3, 4*a* and 4*b* illustrate further details of the cell. The cell preferably has a rectangular cross-section as shown in FIG. 3 in which the width is about one-half the length. Two alternative cell designs have been investigated (I) one large cylindrical cell, and (II) many small two-dimensional cells in a side-by-side array in which the width of each cell is very much smaller than the length. The fluidized-bed electrochemical cell of the present invention has dimensions intermediate between the above two extreme cases. In industrial practice many such rectangular unit cells would be electrically connected in series. The electrolyte solution could be cascaded from cell to cell or fed to all cells from a central manifold. The advantages of such a cell over the above two extreme designs are:

(a) the wall effects are much smaller than in the above two-dimensional cells. The uniformity of fluidization in the cell is better and control of electrolyte solution to the cell is easier. In addition, the problem of feeding seed particles and withdrawing the product particles is substantially overcome by the lower number of two-dimensional cells.

(b) with one large cylindrical cell, an electrical short circuit or malfunction would lead to total shutdown, whereas with many smaller cells electrically connected in series, a unit may be bypassed for purposes of repair without overly effecting production.

(c) electrolyte solution and gas distribution in one large cylindrical cell or many small two-dimensional cells is more difficult than in a few intermediate size rectangular cells. the inlet box of a rectangular cell may be manifolded to control the electrolyte solution distribution.

The electrodes are suspended from a top plate 35 (FIG. 2) and immersed in the fluidized-bed of conducting particles. In the embodiment of FIGS. 2 and 3, they generally consist of cathode feeder electrodes 36 and anode electrodes 38. FIG. 3 shows a checkerboard arrangement of the electrodes in a unit cell. The cathode feeders are typically 7.9 - mm. dia. copper rods in physical contact with the conducting bed of particles. The cathode rods feed electrons to the conducting particles, which in turn accept copper ions from the electrolyte solution to form a deposit of copper. The electrode configuration shown in FIG. 3 is symmetrical in that each anode is surrounded by four cathode feeder rods, and vice-versa. Experiments have shown that a center to center distance between the anode and cathode rods of 42 - mm. (approximately 25.4 - mm. between the nearest points) is optimum for the cell design shown in FIGS. 2 and 3 and the test conditions described later. A greater interelectrode distance increases the cell resistance and specific power consumption, while a smaller distance hinders solids circulation which leads to defluidization and stagnation. The anodes are typically 25.4 - mm. dia. rods made from 5% antimonial lead, although other suitable alloys and materials may be used. A porous membrane 40 preferably made up of polyethylene screen cloth is fitted snuggly over the anode rods. A suitable polyethylene cloth has a mesh count of 156×100 with an average mesh opening of 111 - μm. in a plain square weave. This porous membrane allows the free passage of ions and oxygen produced at the anode surface, but prevents the physical contact between the cathodic bed particles which are greater than 111 - μm. and the anode rods. Experiments have shown that, of the various compositions of commercially available screen cloths, polyethylene gives the best performance. Polytetrafluoethylene (known under the trade mark teflon) has been found to be too thick and oxygen holds up by adsorption in the pores resulting in a very high cell resistance, while polyester rapidly degrades in the presence of acid and iron electrolyte solutions.

Although the checkerboard arrangement has given extremely good results, it is to be understood that other electrode arrangements are also envisaged as it will be seen later.

The distributor 12 (FIGS. 2 and 4*a*, *b*) is preferably a multi-functional distributor through which gas and electrolyte solution are uniformly distributed. As illustrated in FIGS. 4*a* and 4*b*, gas is introduced through a series of bores 42 in the distributor plate, and provided with a series of orfices 44 communicating with such bores. The electrolyte solution is introduced through orifices 46 passing through the complete thickness of the distributor plate. This distributor is capable of handling particulate laden electrolyte without blocking in addition to uniformly distributing gas and electrolyte across the cell. A distributor consisting of a porous linear polyethylene plate may also be used. This type of distributor has given excellent distribution of electrolyte, primarily because it produces a high pressure drop. However, because the pores are tortuous and only about 40 μm. wide, they are easily blocked by particulate matter. Therefore the leach solution must be filtered before entering the inlet box. Consequently, the distributor plate illustrated in FIGS. 4*a* and 4*b* gives better results when a particulate laden electrolyte is used.

Experiments were carried out to determine the effect of copper concentration in the support electrolyte solution on the specific power consumption and current efficiency in the absence of iron. Test results using a 300 - cm.$^2$ rectangular cell with four anode rods placed in a checkerboard arrangement are shown in the following Table I:

efficiency decreases and the specific power consumption increases rapidly below about 1 gpl copper. This may be attributed to the relatively high copper depletion per pass, giving rise to local regions deficient in copper ions, and leading to localized polarization. The curves in FIG. 5 also show that the cell performance with the large particles and porous polyethylene distributor was lower than with small particles and the multifunctional distributor of FIGS. 4*a* and 4*b*. In general, large heavy particles are more susceptive to channelling than small particles, and coupled with poor distribution of air and solution, some of the electrolyte may channel through the bed, which could lead to localized polarization.

Tests 9 to 11 were done to determine the effect of acid concentration and are shown in FIG. 6. The copper concentration in the support electrolyte was maintained about 1.5 gpl to minimize the effect of copper concentration (based on the curves of FIG. 5). The specific power consumption increased from 2.7 to 3.1 kWh/kg. Cu deposited, as the acid concentration decreased from 102 to 37 gpl, while the current efficiency remained essentially constant at about 90%. It should be noted that during long term operation, the acid concentration in the support electrolyte will reach a steady state value which will depend on the copper depletion rate in the cell. For example, if a leach solution containing 18 gpl Cu and 3 gpl $H_2SO_4$ is fed to the cell support electrolyte stream at a rate of 1 liter/min, the steady state material balance gives an acid concentration in the support electrolyte (assuming 70% current efficiency at 800 amp.) of about 20 gpl $H_2SO_4$. This implies that the acid concentration in the support electrolyte is not an independent variable, and that acid make-up will not be necessary for the process flowsheet shown in FIG. 1 as long as the cell functions efficiently at this concentration.

TABLE I

TEST RESULTS FOR CONTINUOUS OPERATION WITH IRON-FREE SOLUTION IN 300-cm.$^2$ CELL[1]

| | Average Current and Voltage | | Pregnant Solution | | | Support Electrolyte | | | | Cell Performance | | | |
|---|---|---|---|---|---|---|---|---|---|---|---|---|---|
| Test No.[2] | Cell Current, amp. | Cell Voltage[3], volts | Cu conc., gpl | $H_2SO_4$ conc., gpl | Flow-rate, liter/min. | Cu conc. into CELL, gpl | Cu Conc. out of CELL, gpl | $H_2SO_4$ conc., gpl | Flow-rate, liter/min. | Copper Depletion Rate, g./min. | Copper Depletion Per Pass, % | Current Efficiency, % | Specific Power Consumption[3] kWh/kg. Cu |
| 1 | 850 | 3.25 | 27.3 | 110 | 0.45 | 2.1 | 1.70 | 119 | 30.0 | 12.4 | 19 | 74 | 3.7 |
| 2 | 850 | 3.25 | 27.3 | 110 | 0.40 | 1.6 | 1.20 | 130 | 30.0 | 10.8 | 25 | 64 | 4.3 |
| 3 | 850 | 3.25 | 27.3 | 110 | 0.26 | 0.8 | 0.50 | 120 | 30.0 | 7.0 | 37 | 41 | 6.7 |
| 4 | 850 | 3.05 | 27.3 | 110 | 0.52 | 3.6 | 3.20 | 140 | 30.0 | 12.6 | 11 | 75 | 3.4 |
| 5 | 800 | 3.20 | 27.3 | 110 | 0.56 | 2.3 | 0.70 | 130 | 9.0 | 14.8 | 71 | 93 | 2.9 |
| 6 | 800 | 3.00 | 27.3 | 110 | 0.62 | 3.8 | 2.10 | 125 | 9.0 | 15.6 | 45 | 99 | 2.6 |
| 7 | 800 | 3.25 | 27.3 | 110 | 0.37 | 1.4 | 0.28 | 133 | 90 | 10.1 | 80 | 64 | 4.3 |
| 8 | 800 | 2.96 | 27.3 | 110 | 0.54 | 3.0 | 1.50 | 102 | 9.4 | 14.4 | 51 | 91 | 2.7 |
| 9 | 800 | 3.00 | 30.7 | 73 | 0.52 | 4.0 | 2.60 | 70 | 9.4 | 13.6 | 36 | 86 | 2.9 |
| 10 | 800 | 3.30 | 32.2 | 25 | 0.50 | 4.3 | 3.10 | 37 | 11.0 | 14.2 | 30 | 90 | 3.1 |

[1]Bed expansion 12%; air flowrate, 60.3 liter/min.; mean bed temperature, 26° C.
[2]Tests 1 to 4 were carried out with 500-μm. copper particles and porous polyethylene distributor; the current intensity was 66.5 × 10$^3$ amp./m.$^3$ Tests 5 to 10 were carried out with 200-μm. copper particles and a multifunctional distributor (FIG. 4); current intensity was 62.6 × 10$^3$ amp./m$^3$.
[3]Anode-cathode voltage; the specific power consumption does not include power to pump air and electrolyte.

The average copper concentration in the solution flowing into the cell was calculated on the basis of the pregnant and support electrolyte flow rates and their respective copper concentrations. The support electrolyte in the tank was analyzed for copper at one-half hour intervals, and the concentrations recorded in Table I are the arithmetic average during operation at quasi-steady state. The experiments were carried out at average acid concentrations between 102 and 140 gpl. Tests 1 to 4 were done with relatively large copper particles (about 500 - μm.) using the porous polyethylene distributor, while tests 5 to 9 were done with smaller particles (about 200 - μm.) using the multifunctional distributor illustrated in FIGS. 4*a* and 4*b*.

FIG. 5 shows that both the specific power consumption and current efficiency approach an asymptotic value as the copper concentration in the support electrolyte increases above about 1.5 gpl, while the current Experiments were also carried out to determine the effect of the copper concentration in the support electrolyte on the specific power consumption and the current efficiency for solutions containing iron. The results with an iron bearing solution containing about 7.3 gpl total iron, of which 5.9 gpl was in ferrous form, are plotted in FIG. 7 and listed in the following Table II:

TABLE II

TEST RESULTS FOR CONTINUOUS OPERATION WITH IRON-BEARING SOLUTIONS IN 300-cm.$^2$ CELL[1]

| | Average Current and Voltage | | Pregnant Solution | | | | | Support Electrolyte | | | | | | |
|---|---|---|---|---|---|---|---|---|---|---|---|---|---|---|
| | | | | Iron Conc., gpl | | | | | | Iron Conc., gpl | | | | |
| Test No. | Cell Current, amp. | Cell Voltage[2], volts | Cu Conc., gpl | Total Fe | $Fe^{++}$ | $H_2SO_4$ Conc., gpl | Flow Rate, liter/min. | Cu. Conc. Into Cell gpl | Cu. Conc. Out of Cell gpl | Total Fe | $Fe^{++}$ | $H_2SO_4$ Conc., gpl | Flow Rate, liter/min. | Temp., °C. |
| 13 | 800 | 3.55 | 18.8 | 0.0 | 0.0 | 3.3 | 0.86 | 4.8 | 4.0 | 0.0 | 0.0 | 26 | 15.0 | 29 |
| 14 | 800 | 4.10 | 18.4 | 7.1 | 5.9 | 4.4 | 0.66 | 4.5 | 3.9 | 7.4 | 5.8 | 25 | 15.0 | 33 |
| 15 | 800 | 4.20 | 18.4 | 7.1 | 5.8 | 4.9 | 0.40 | 2.1 | 1.7 | 7.3 | 5.8 | 30 | 15.0 | 32 |
| 16 | 800 | 4.30 | 18.4 | 7.0 | 6.1 | 4.2 | 0.98 | 7.7 | 7.2 | 7.3 | 6.0 | 21 | 15.0 | 31 |
| 17 | 800 | 3.88 | 18.4 | 6.8 | 5.8 | 4.7 | 0.66 | 5.2 | 4.6 | 7.1 | 5.8 | 26 | 15.0 | 49 |
| 18 | 600 | 3.24 | 18.4 | 6.8 | 5.8 | 4.7 | 0.51 | 4.7 | 4.2 | 7.2 | 5.8 | 27 | 15.0 | 46 |
| 19 | 400 | 2.88 | 18.4 | 6.8 | 5.8 | 4.7 | 0.36 | 6.3 | 6.0 | 7.1 | 5.9 | 22 | 15.0 | 45 |

| | Cell Performance | | | |
|---|---|---|---|---|
| Test No. | Copper Depletion Rate, g/min. | Copper Depletion Per Pass % | Current Efficiency, % | Specific Power Consumption[2] kWh/kg. Cu |
| 13 | 12.7 | 18 | 80 | 3.7 |
| 14 | 9.4 | 14 | 60 | 5.9 |
| 15 | 6.7 | 21 | 43 | 8.3 |
| 16 | 10.4 | 9 | 66 | 5.5 |
| 17 | 9.1 | 12 | 57 | 5.7 |
| 18 | 8.3 | 12 | 69 | 4.0 |
| 19 | 4.4 | 5 | 56 | 4.2 |

[1]Bed expansion ~12%, air flow rate 60.3 liter/min.; copper particle size ~200 μm.
[2]Anode-cathode voltage; the specific power consumption does not include power to pump air and electrolyte.

The specific power consumption and the current efficiency approach asymptotic values of approximately 5.5 kWh/kg. Cu and 66%, respectively, as the copper concentration increases above about 6 gpl. At low copper concentrations, the specific power consumption rapidly increases and the current efficiency rapidly decreases. The form of the curves in FIG. 7 is similar to the ones for iron-free solutions illustrated in FIG. 5.

A comparison of the cell performance with iron-free and iron-bearing solutions is illustrated in the following Table III under the same operating conditions.

TABLE III

COMPARISON OF CELL PERFORMANCE FOR IRON-FREE AND IRON-BEARING SOLUTION[1]

| | Average Anode/Cathode Voltage, volts | Critical Cu conc., gpl[2] | Specific Power Consumption, kWh/kg. Cu | Current Efficiency, % |
|---|---|---|---|---|
| Iron-Free | 3.5 | 1.5 | 2.6 | 95 |
| Iron-Bearing[3] | 4.2 | 6 | 5.5 | 66 |

[1]Cell current 800 amp., $H_2SO_4$ conc. 25–30 gpl, temperature 32° C.
[2]Copper concentration above which the specific power consumption and current efficiency approach asymptotic values.
[3]Total iron 7.3 gpl of which 5.9 gpl is ferrous.

In the presence of iron, over one half of the power is consumed in the cyclic redox ferrous/ferric reaction in the cell. Ferrous ions are oxidized at the anode surface and the ferric ions in turn are reduced at the surface of the cathodic particles. These reactions are mass transfer controlled, and so proceed rapidly in the fluidized-bed. In general, it has been found that as the iron concentration increases above 7 gpl, the specific power consumption increases and the current efficiency decreases beyond the values given in Table III. Also, the critical copper concentration increases and the shape of the characteristic curves are similar to those of FIG. 7.

In tests 13 to 16 of Table II, the solution in the support electrolyte tank was cooled to between 26° and 33° C. No cooling was employed in tests 17 to 19 of Table II and the cell temperature was allowed to increase. The equilibrium cell temperature varied between 45° and 49° C. depending upon the cell current. Comparison of tests 14 and 17 of Table II which were run under similar conditions shows that an increase in temperature from 33° C. to 49° C. resulted in a decrease in cell voltage from 4.10 to 3.88 volts, current efficiency from 60 to 57%, and specific power consumption from 5.9 to 5.7 kWh/kg. Cu. It may be concluded that within this range, cell temperature has very little effect on the performance of the cell.

Tests 17 to 19 in Table II show the effect of cell current over the range 400 to 800 amp. The results are plotted in FIG. 8. The specific power consumption passes through a minimum of 4.0 kWh/kg. Cu and the current efficiency through a maximum of 69%, at about 600 amp. The three predominant factors which may contribute to this behaviour are the iron redox cycle, copper redissolution and concentration polarization. The extremes in FIG. 8 indicate that for currents less than 600 amp., copper redissolution is the major contributor to decreased current efficiency and for currents greater than 600 amp., concentration polarization and the iron redox cycle may be the predominant factors.

In directly electrowinning leach solution containing, for example, 10–20 gpl Cu, ~7 gpl total iron and ~3 gpl $H_2SO_4$, it would be advantageous to reduce the copper level to less than 1.0 gpl Cu. Experiments showed that the cell with polyethylene screen cloth around the anodes was incapable of electrowinning efficiently to such low copper levels in the presence of iron. The two major causes of poor cell performance were the cyclic ferrous/ferric redox reaction, and redissolution of the particulate copper phase. Both of these factors were enhanced because the anolyte and catholyte were not physically separated. Ferric ions were thus readily reduced in the cathode bed. Also, oxygen bubbles produced at the surface of the anodes, as well as oxygen in the fluidizing air, enhanced the redissolution of copper.

It was found that the above problem would be overcome by the use of an ion exchange membrane around the anodes as a means of separating the anode and cathode reactions. The cell shown in FIG. 9 is a 100 - mm. dia. cell having a single cylindrical lead anode (38 - mm. o.d. and 32 - mm. i.d.) tube 50 covered by an ion exchange membrane tube 52 which is slipped over the anode. As shown in FIG. 10, the lead anode is perforated at 45° to allow the free evolution of $O_2$ bubbles. The membrane used was a perfluorosulphonic acid ion exchange membrane made by Du Pont under the trade name Nafion; it was supplied as a tube which fitted loosely over the lead tube. Nafion is claimed by the manufacturer to be resistant to acid concentrations up to 100 gpl $H_2SO_4$, with excellent conductivity properties, and it allows the passage of $H^+$ ions while inhibiting the larger ferric ions from entering the anolyte.

The cathode in the cell is a cylindrical copper tube 54 (FIG. 9) which is concentric with the anode and also forms the cell wall. The multifunctional distributor 56 is similar in design to the one used in the 300 - cm.$^2$ rectangular cell and shown in FIGS. 4*a* and 4*b*. The anode tube is seated into a recess 58 in the distributor and blocks the particle outlet tube 60 during operation. At the end of an experiment, the anode was raised to allow product particles to be removed through outlet tube 60 and new seed particles were fed through the seed inlet 61. As in the 300 - cm.$^2$ cell, the electrolyte enters the solution inlet 62 and exits through the solution outlet 64. A screen filter 66 prevents the copper particles from running out from the outlet box 68 of the cell. As shown in FIG. 10, the anode is closed at the bottom by a plug 70 to ensure separation of catholyte and anolyte.

In the previous test 18 of Table II with polyethylene screen anodes, the optimum cell current was 600 amp. through a bed of 300 cm.$^2$ cross-section and 30 cm. expanded depth to give a current intensity of about 67,000 amp./m.$^3$. The 100 - mm. dia. cell was designed to give the same current intensity and bed depth at 150 amp.

The results of tests in this cell are summarized in Table IV. In all tests except test 23, the pregnant solution contained about 10 gpl Cu, 7 gpl total iron and 15–17 gpl $H_2SO_4$. Nitrogen agitation was used instead of air agitation in tests 23, 26, 27 and 28 in order to determine its effect on cell performance. The volume of anolyte was maintained constant during the experiments by intermittently adding fresh water make-up to the anolyte.

TABLE IV

TEST RESULTS FOR CONTINUOUS OPERATION WITH IRON-BEARING SOLUTION IN 100-mm. DIA. CELL USING AN ION EXCHANGE MEMBRANE[1]

| | Average Current and Voltage | | Pregnant Solution | | | | Support Electrolyte | | | | | | Cell Performance | | | |
|---|---|---|---|---|---|---|---|---|---|---|---|---|---|---|---|---|
| Test No. | Cell Current amp. | Cell Voltage,[2] volts | Cu Conc.,[4] gpl | Total Iron Conc.,[5] gpl | $H_2SO_4$ Conc., gpl | Flow Rate, liter/min. | Cu Conc. Into Cell,[5] gpl | Cu Conc. Out of Cell,[4] gpl | Temp. °C. | Total Iron Conc., gpl | $H_2SO_4$ Conc., gpl | Flow Rate, liter/min. | Copper Depletion Rate, g./min. | Copper Depletion Per Pass, % | Current Efficiency, % | Specific Power Consumption,[2] KWh/kg Cu |
| 20 | 150 | 3.80 | 10.6 | 7.0 | 17.0 | 0.14 | 0.75 | 0.56 | 33 | 7.0 | 32 | 7.5 | 1.4 | 25 | 48 | 6.7 |
| 21 | 150 | 3.46 | 10.6 | 7.0 | 17.0 | 0.23 | 1.48 | 1.20 | 25 | 6.7 | 30 | 7.5 | 2.1 | 19 | 72 | 4.0 |
| 22 | 150 | 3.50 | 10.6 | 7.0 | 17.0 | 0.27 | 2.07 | 1.75 | 23 | 6.5 | 29 | 7.5 | 2.4 | 15 | 79 | 3.7 |
| 23 | 150 | 3.39 | 7.1 | 7.0 | 15.5 | 0.18 | 0.81 | 0.65 | 27 | 6.7 | 30 | 7.5 | 1.2 | 20 | 37 | 7.7 |
| 24 | 150 | 3.62 | 10.4 | 7.0 | 15.5 | 0.05 | 0.15 | 0.08 | 24 | 6.5 | 31 | 7.5 | 0.5 | 46 | 17 | 18.1 |
| 25 | 150 | 3.44 | 10.4 | 7.0 | 15.5 | 0.19 | 1.01 | 0.78 | 25 | 6.6 | 30 | 7.5 | 1.8 | 23 | 59 | 4.5 |
| 26 | 150 | 3.37 | 10.7 | 7.0 | 15.0 | 0.28 | 1.85 | 1.53 | 23 | 6.7 | 31 | 7.5 | 2.6 | 18 | 85 | 3.4 |
| 27 | 150 | 3.37 | 10.7 | 7.0 | 15.0 | 0.19 | 0.95 | 0.70 | 22 | 6.8 | 28 | 7.5 | 1.9 | 26 | 63 | 4.5 |
| 28 | 150 | 3.44 | 10.7 | 7.0 | 15.0 | 0.14 | 0.67 | 0.48 | 23 | 6.6 | 30 | 7.5 | 1.4 | 28 | 47 | 6.1 |

[1] Bed expansion ~12%; air flow rate 9.0 liter/min.; copper particle size ~270μm.
[2] Anode-cathode voltage; the specific power consumption does not include power to pump air and electrolyte.
[3] Air replaced by nitrogen at 9.0 liter/min.
[4] By titration.
[5] By calculation.
[6] Test results for test 23 are suspect and are not included in FIGS. 1 and 2.

FIGS. 11 and 12 show the effect of copper concentration in the support electrolyte on current efficiency and specific power consumption. Also shown for comparison are test results using the 300 - cm.$^2$ cell with polyethylene screened anodes and air agitation. A very marked improvement in cell performance was obtained with the ion exchange membrane cell. For example, at 1 gpl Cu in the support electrolyte, the current efficiency increased from about 25% to 67%, and the specific power consumption decreased from 12 kWh/kg of Cu to 4 kWh/kg, in the presence of about 7 gpl total iron. It should be emphasized that a three-fold increase in current efficiency is effectively a ⅓ reduction in cell size for the same capacity.

It was also shown that the ion exchange membrane cell could electrowin at a copper level of 0.08 gpl with a 17% current efficiency and a power consumption of 18 kWh/kg of Cu deposited. Electrowinning at this copper concentration was not possible with the previous cell.

When nitrogen was used for agitation, the current efficiency increased and the specific power consumption decreased marginally, as shown in FIGS. 11 and 12.

FIGS. 13 and 14 illustrate a cross-sectional view and a top view, respectively, of a 300 cm.$^2$ rectangular cell with an ion exchange membrane and FIG. 15 shows the details of its rectangular anode compartment which is made of two planar lead anodes 70 separated by an anolyte compartment 71. The two anode sheets have holes 72 at a 45° angle to allow the free evolution of oxygen through the inner anolyte compartment. The planar anodes are housed in insulating support frames 74 with two windows 76, one on each side. An ion exchange membrane 78 covers each window to prevent physical contact between the cathodic copper particles and the anodic lead sheets. The pre-assembled anode compartment is suspended by a top support plate 79 in the fluidized-bed of copper particles so that the expanded bed covers the window area. Ten copper feeder rods 80, five facing each side, are immersed in the bed of copper particles. The lead sheets are supported by an inner insulating frame (not shown) so that they are flush with the inside surface of the membranes. This substantially reduces the anolyte distance between the surface of the lead sheet and thus the overall cell-membrane resistance. Oxygen evolved on the surface of the lead sheets escapes through the holes and bubbles up through the anolyte. The two insulating frames are fastened to the inner frame to sandwich the membranes and lead sheets together. Silicone rubber sealant is used as a gasket to prevent leakage. Teflon reinforced, Nafion sheets have been used since these are much stronger than the unreinforced ion exchange membranes.

Experiments were concluded using the above disclosed 300 - cm.$^2$ rectangular cell with an ion exchange membrane to demonstrate the performance of the Teflon-reinforced exchange membranes. In early tests, problems were encountered with high cell resistance, agglomeration and leaks. These problems were resolved by decreasing the bed expansion and increasing the bed agitation (reducing the recycle support solution flowrate and increasing the air flowrate). This increased the bed conductivity and prevented agglomeration which had caused burn-through of the membranes and subsequent leaks.

Four experiments were successfully completed to determine the effect of copper concentration in the support electrolyte on the current efficiency and specific power consumption. The results are shown in Table V and FIG. 16. Also plotted in FIG. 16 for comparison are the results for the unreinforced membrane in the 100 - mm. dia. cell and the polyethylene screen cloth in the 300 - cm.$^2$ cell.

TABLE V

TEST RESULTS FOR TEFLON-REINFORCED NAFION MEMBRANES IN THE 300-CM.$^2$ CELL[1]

| | Average Current and Voltage | | Pregnant Solution | | | | Support Electrolyte | | | | | Cell Performance | | |
|---|---|---|---|---|---|---|---|---|---|---|---|---|---|---|
| Test No. | Cell Current amp. | Cell Voltage[2], volts | Cu Conc., gpl | Total Iron Conc., gpl | $H_2SO_4$ Conc., gpl | Flow Rate liter/min. | Cu Conc. Out of Cell, gpl | Temp. °C. | Total Iron Conc., gpl | $H_2SO_4$ Conc., gpl | Flow Rate, liter/min. | Copper Depletion Per Pass % | Current Efficiency % | Specific Power Consumption[2], kWh/kg. Cu |
| 29 | 600 | 4.0 | 14.6 | 7.4 | 36 | 0.85 | 4.2 | 55 | 8.0 | 47 | 11.0 | 71 | 75 | 4.5 |
| 30 | 600 | 4.0 | 14.6 | 7.4 | 36 | 0.65 | 2.2 | 55 | 7.7 | 51 | 11.0 | 85 | 66 | 5.1 |
| 31 | 605 | 4.0 | 14.6 | 7.4 | 37 | 0.45 | 1.3 | 55 | 7.7 | 54 | 11.0 | 91 | 50 | 6.8 |
| 32 | 600 | 4.1 | 14.6 | 7.4 | 37 | 0.30 | 1.0 | 55 | 7.4 | 57 | 11.0 | 93 | 34 | 9.9 |

[1]Bed expansion ~12%; air flowrate 65 liter/min.; copper particle size ~250 um.;
[2]Anode-cathode voltage; the specific power consumption does not include power to pump air and electrolyte.

FIG. 16 shows that the current efficiency with the unreinforced membrane is considerably higher than with either the reinforced membrane or the polyethylene screen cloth in the copper concentration range 0–3 gpl. For example, the copper concentration in the pregnant solution can be reduced to 1 gpl at a current efficiency of about 65% for the unreinforced membrane whereas it is about 40% with the reinforced membrane and only about 27% with the polyethylene screen cloth. This was to be expected because the polyethylene screen cloth allows the free transfer of electrolyte through its open pores, whereas the ion exchange membrane inhibits the transfer of ferrous and ferric ions and reduces this cyclic redox reaction which consumes electricity and reduces the current efficiency. Also, $O_2$ produced at the anode is prevented from entering the catholyte by the membrane. Finally, the unreinforced membrane performs better than the reinforced membrane because the free surface area for ion transfer is larger; the Teflon mesh in which the ion exchange resin is impregnated is impermeable to ion transfer.

FIG. 16 also shows that the specific power consumption is substantially lower with the unreinforced membrane at low copper concentration. For example, the copper concentration in the pregnant solution can be reduced to 1 gpl at a specific power consumption of 4.1 kWh/kg. Cu deposited for the unreinforced membrane whereas it is 8 and 10.5 kWh/kg. Cu for the reinforced membrane and polyethylene screen cloth, respectively.

Electrowinning down to a copper concentration of 0.5 gpl in a single stage is fairly expensive. Therefore, one modification of the process illustrated in FIG. 1 is shown in FIG. 17 which consists of a cascade system with three stages 90, 91 and 92. The process flowsheet of FIG. 17 is for the treatment of 230 M USGPD of pregnant leach solution containing 18.8 gpl Cu, 7.5 gpl Fe and 3 gpl $H_2SO_4$ to produce about 35,000 lb/day of anode copper in furnace 93. In the first stage 90, the copper concentration is decreased to about 5 gpl at a low power consumption. In the second and third stages 91 and 92, the copper content is lowered down to 1 gpl and 0.5 gpl respectively at a higher power consumption. The effluent from the third stage contains about 30 gpl $H_2SO_4$. Part of it (100 M USGPD) is recycled to the final wash of the vat leach process whereas the remainder is treated with lime before disposal. FIG. 18 shows another modification of the process of FIG. 1 consisting of one stage identical to the first stage 90 in the cascade system of FIG. 17. In this case the partially stripped electrolyte is recycled to the fresh ore vat 94 to consume the acid (25 gpl) and the remaining copper (~7 gpl) is recovered in the cementation plant 96. Part of the effluent from the cementation plant is recycled to the final wash of the vat leach process (100 M USGPD) whereas the remainder is sent to disposal.

Although the above process and apparatus have been disclosed in relation to electrowinning of copper, it is to be understood that it could be used with perhaps minor modifications for electrowinning other metals and it is understood that the invention is to be limited by the following claims only.

What is claimed is:

1. An apparatus for continuously electrowinning metal from leach solutions comprising:

(a) at least one cell having a grid supporting a bed of particulate conducting particles;

(b) means for uniformly distributing and continuously recirculating a support solution of predetermined metal concentration through said bed of conducting particles at a sufficiently high flow rate to fluidize and expand said bed by about 5 to 25%;

(c) means for continuously and uniformly feeding gas through the bed of conducting particles at a flow rate such as to contract the bed and operate the bed at low expansion between 5 and 25% while creating an intense particle agitation to maintain good mixing and uniform fluidization of the bed of particles;

(d) an electrode arrangement suspended from the top of the cell and adapted to be immersed in said bed of fluidized particles and consisting of at least one cathode feeder electrode adapted to come in physical contact with the fluidized particles during fluidization to make the particles cathodic and so cause the metal ions to deposit on the particles, and at least one anode electrode separated from the cathodic particles by a membrane which allows the free passage of ions while preventing physical contact with the particles; and (e) means for adding small seed particles at the top of the cell and means for withdrawing large product particles from the bottom of the cell so as to make the apparatus work continuously or semi-continuously.

2. An apparatus as defined in claim 1, wherein said metal is copper.

3. An apparatus as defined in claim 1, comprising a plurality of cells which are electrically connected in series and wherein the support solution is cascaded from one cell to the other or fed to all cells from a center manifold.

4. An apparatus as defined in claim 1, wherein each cell has a rectangular cross-section in which the thickness of the cell is about one half its width.

5. An apparatus as defined in claim 1, wherein said grid is a distributor plate provided with a series of bores in the plane of the distributor plate, each provided with a series of orifices communicating with said bores to feed air into the bed of particles, and wherein the support solution is fed through orifices passing through the complete thickness of the distributor plate.

6. An apparatus as defined in claim 1, wherein said electrode arrangement is a checkerboard arrangement wherein each anode electrode is surrounded by four cathode feeder electrodes and vice-versa.

7. An apparatus as defined in claim 1, wherein the membrane is a polyethylene screen cloth fitting snuggly over the anode electrodes.

8. An apparatus as defined in claim 1, wherein the anode is a cylindrical anode tube and wherein the membrane is an ion exchange membrane fitted around the anode tube, said anode tube being perforated to allow the free evolution of oxygen inside the anode tube.

9. An apparatus as defined in claim 1, wherein the anode consists of two planar anode sheets spaced at a predetermined distance and supported by an insulating frame so as to form an inner anolyte compartment, wherein windows are provided in said frame facing said anode sheets and within said fluidized-bed, and wherein said membrane is an ion exchange membrane which covers each window to prevent physical contact between the cathodic particles and the anodic lead sheets, each anodic sheet having holes therein to allow the free evolution of oxygen through the anolyte compartment.

* * * * *